US007887006B2

(12) United States Patent
Kazuyuki

(10) Patent No.: US 7,887,006 B2
(45) Date of Patent: Feb. 15, 2011

(54) WINDING REEL FOR BAND-SHAPED MATERIAL

(75) Inventor: Hoshi Kazuyuki, Tokyo (JP)

(73) Assignees: Kabushiki Kaisha Sato (JP); Sato Knowledge and Intellectual Property Institute (JP)

( * ) Notice: Subject to any disclaimer, the term of this patent is extended or adjusted under 35 U.S.C. 154(b) by 119 days.

(21) Appl. No.: 11/938,423

(22) Filed: Nov. 12, 2007

(65) Prior Publication Data

US 2008/0179442 A1 Jul. 31, 2008

(30) Foreign Application Priority Data

Jan. 30, 2007 (JP) ..... 2007-019380

(51) Int. Cl.
*B65H 75/24* (2006.01)

(52) U.S. Cl. ..... 242/573.9; 242/575

(58) Field of Classification Search ..... 242/573.9, 242/573.7, 597, 597.1–6, 572, 575, 576
See application file for complete search history.

(56) References Cited

U.S. PATENT DOCUMENTS

| | | | | |
|---|---|---|---|---|
| 2,042,968 | A * | 6/1936 | Siegenthaler | 242/573.7 |
| 2,746,689 | A * | 5/1956 | Berkepeis | 242/573.1 |
| 2,860,838 | A * | 11/1958 | Keith | 242/573.9 |
| 2,882,078 | A * | 4/1959 | MacDonald | 242/597.3 |
| 3,899,141 | A * | 8/1975 | Padgett, Jr. | 242/597.6 |
| 4,359,194 | A * | 11/1982 | Buehler et al. | 242/573.1 |
| 6,095,704 | A * | 8/2000 | Jaeger et al. | 400/613 |
| 7,506,834 | B2 * | 3/2009 | Lenkl | 242/573.7 |

FOREIGN PATENT DOCUMENTS

| | | |
|---|---|---|
| JP | 2-149650 | 12/1990 |
| JP | 8-128433 A | 5/1996 |
| JP | 10-137848 A | 5/1998 |
| JP | 2004-299862 A | 10/2004 |

OTHER PUBLICATIONS

International Search Report from PCT/JP2008/051206 dated Apr. 15, 2008.

* cited by examiner

*Primary Examiner*—Michael R Mansen
*Assistant Examiner*—Juan J Campos
(74) *Attorney, Agent, or Firm*—Ostrolenk Faber LLP

(57) ABSTRACT

A winding reel for a band-shaped material that makes it possible to remove the wound band-shaped material by a simple operation, without adjusting the winding speed of the band-shaped material. A winding reel for a band-shaped material is configured by attaching an outer circumferential member to a member with a reducing outer diameter of an inner circumferential member. The outer diameter of the member with a reducing outer diameter and the inner diameter of mating members that constitute the outer circumferential member decrease from the base end side toward the distal end side. In the outer circumferential member attached to the member with a reducing outer diameter, the inner surfaces of the mating members are brought into contact with the outer surface of the member with a reducing outer diameter and supported by the outer surface of the member with a reducing outer diameter. An engagement portion is provided at a distal end portion of a rotary shaft to which the member with a reducing outer diameter is attached. An engagement piece located inside a fixing tube of a fixing cap engages with the engagement portion. The engagement piece located inside the fixing tube and the engagement portion are configured so that the engagement thereof can be released.

2 Claims, 11 Drawing Sheets

WINDING REEL FOR BAND-SHAPED MATERIAL

CROSS-REFERENCE TO RELATED APPLICATIONS

This application claims the benefit of the filing date of Japanese Patent Application No. 2007-019380 filed Jan. 30, 2007, the disclosure of which is hereby incorporated by reference.

BACKGROUND OF THE INVENTION

1. Field of the Invention

The present invention relates to a winding reel for a band-shaped material such as an ink ribbon.

2. Description of the Related Art

A take-up reel for a ribbon or the like is disclosed in Japanese Patent Application Laid-open No. 6-127064 as a reel of the aforementioned type. This take-up reel for a ribbon or the like is configured of a pair of body portions that are assembled together and constitute a body of the reel. In both body portions, a spring plate is attached to a base end surface and a disk is attached to a distal end surface. The spring plates are tightly screwed to the base end surfaces of both body portions, thereby fixing the positions of the base end surfaces of both body portions. In the disk, a pair of projections are provided on one surface, and these projections are sandwiched between the two body portions and attached thereto. Both body portions are tightly screwed to a bearing plate via the spring plates, and the bearing plate is attached to a rotary shaft, thereby fixing the two body portions to the rotary shaft.

In the take-up reel for a ribbon or the like, an ink ribbon is wound on the outer circumference of the two body portions by rotating the two body portions integrally with the rotary shaft. If the disk is removed from the distal ends of the two body portions and the projections of the disk are pulled out from between the two body portions after the winding of the ink ribbon has been completed, the distal end sides of the two body portions are tilted inwardly by a tightening force applied by the wound ink ribbon, and a gap is generated between the two body portions and the wound ink ribbon. As a result, the wound ink ribbon can be pulled out from the reel.

SUMMARY OF THE INVENTION

However, in the take-up reel for a ribbon or the like disclosed in Japanese Patent Application Laid-open No. 6-127064, because the base end portions of the body portions are fixed by the spring plate or bearing plate and the outer diameter of the base end side of the reel does not change even when the disk is removed, it might be impossible to pull out the wound ink ribbon from the reel due to a tightening force applied to the base end portion of the reel by the ink ribbon, e.g. at a certain winding rate of the ink ribbon. As a result, it is necessary to perform a fine adjustment of the winding speed according to the material of the ink ribbon that is to be wound or the winding quantity in order to inhibit the tightening force applied by the ink ribbon to the reel to a degree that makes it possible to pull the ink ribbon out from the base end portion of the reel.

The present invention was conceived with the foregoing in view and it is an object thereof to provide a winding reel for a band-shaped material that resolves the above-described problems.

In order to attain the above-described object, the present invention provides a winding reel for a band-shaped material configured to comprise: an inner circumferential member comprising a portion with a reducing outer diameter in which the outer diameter decreases from one end portion toward the other end portion; an outer circumferential member that is attached to the outer circumference of the inner circumferential member, rotates integrally with the inner circumferential member, and serves for winding the band-shaped material on the outer circumference thereof; and fixing means for releasably fixing an attachment position of the outer circumferential member to the inner circumferential member, wherein the outer circumferential member comprises a portion with a reducing inner diameter in which the inner diameter decreases from the one end portion toward the other end portion and is configured to be expandable and contractable in a radial direction, and the portion with a reducing inner diameter is attached to the inner circumferential member by being supported on the portion with a reducing outer diameter.

The winding reel for a band-shaped material in accordance with the present invention can comprise axial biasing means for biasing the outer circumferential member from the one end portion of the inner circumferential member toward the other end portion thereof.

The winding reel for a band-shaped material in accordance with the present invention can comprise radial biasing means for biasing the outer circumferential member in a direction of diameter reduction.

In the winding reel for a band-shaped material in accordance with the present invention, the outer circumferential member is configured by screwing together and mating a plurality of mating members that are split along the circumferential direction, so that the mating members can move in the radial direction, and the radial biasing means is configured by an elastic body inserted between the mating members and a screw that screws together the mating members.

With the winding reel for a band-shaped material in accordance with the present invention, the wound band-shaped material can be removed from the winding reel for a band-shaped material by a simple operation of releasing the fixation with the fixing means, without adjusting the winding speed of the band-shaped body.

BRIEF DESCRIPTION OF THE DRAWINGS

FIG. 10A shows a state before the diameter of the outer circumferential member is reduced, and FIG. 10B shows a state after the diameter of the outer circumferential member has been reduced; FIG. 11A shows a state before the diameter of the outer circumferential member is reduced, and FIG. 11B shows a state after the diameter of the outer circumferential member has been reduced.

BEST MODE FOR CARRYING OUT THE INVENTION

A winding reel for a band-shaped material of the preferred embodiment of the present invention will be described below with reference to the appended drawings.

Figure 1:
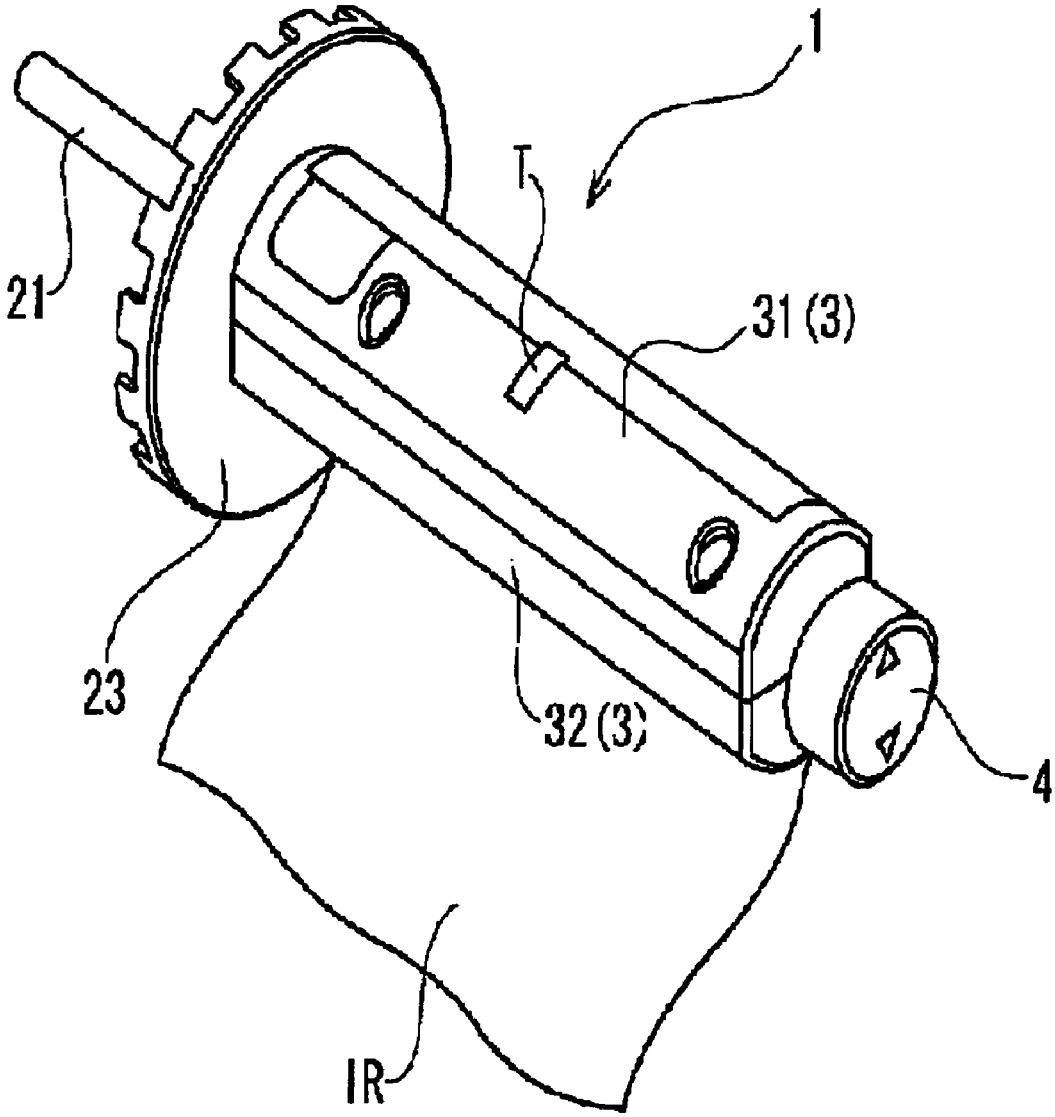
FIG. 1 is a perspective view illustrating a state in which an ink ribbon is wound on a winding reel for a band-shaped material of the preferred embodiment of the present invention.
Figure 2:
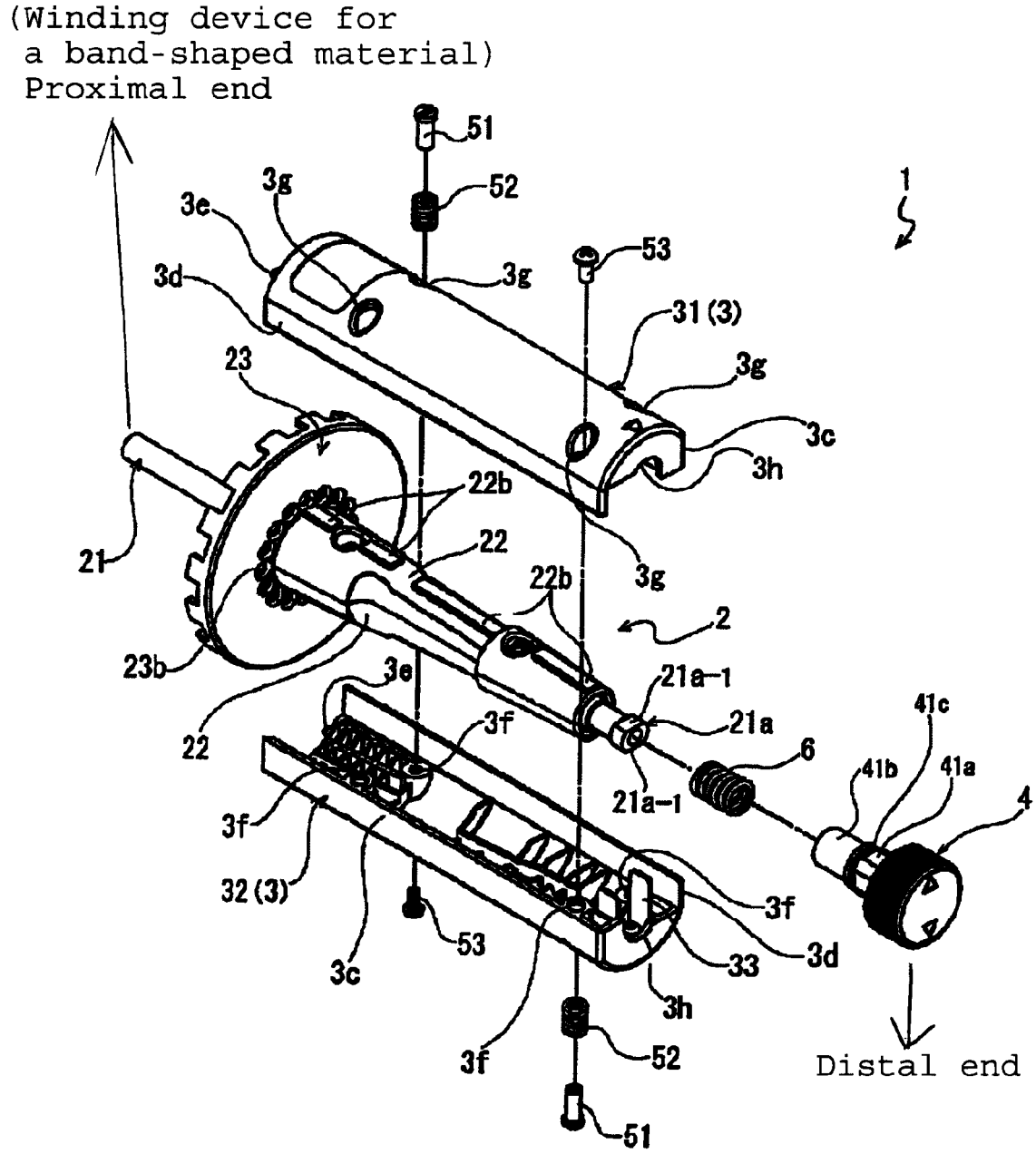
FIG. 2 is an exploded perspective view of the winding reel for a band-shaped material shown in FIG. 1.

FIG. 1 is a perspective view illustrating a state in which an ink ribbon IR is wound on a winding reel 1 for a band-shaped material of the present embodiment. FIG. 2 is an exploded perspective view illustrating the configuration of the winding reel 1 for a band-shaped material.

The winding reel 1 for a band-shaped material is designed for winding a band-shaped material, this material being an ink ribbon IR in the present embodiment. As shown in FIG. 1 the ink ribbon IR is found on the outer periphery of the reel. As shown in FIG. 2, the winding reel 1 for a band-shaped material comprises an inner circumferential member 2, an outer circumferential member 3 that covers the outer circumference of the inner circumferential member 2, and a fixing cap 4 that in the attached position fixes the outer circumferential member 3 with respect to the inner circumferential member 2 in the attached position. The winding reel 1 for a band-shaped material is used so that the fixing cap 4 is provided on the distal end side, and the base end side is attached to a band-shaped material winding device.

As shown in FIG. 2, the inner circumferential member 2 comprises a rotary shaft 21, a member 22 with a reducing outer diameter that covers the outer circumference of the rotary shaft 21, and a shaft flange 23 through which the rotary shaft 21 is inserted. The rotary shaft 21 is a rotary shaft of the winding reel 1 for a band-shaped material. The rotary shaft 21 is formed from a metal such as a stainless steel.

Figure 3:
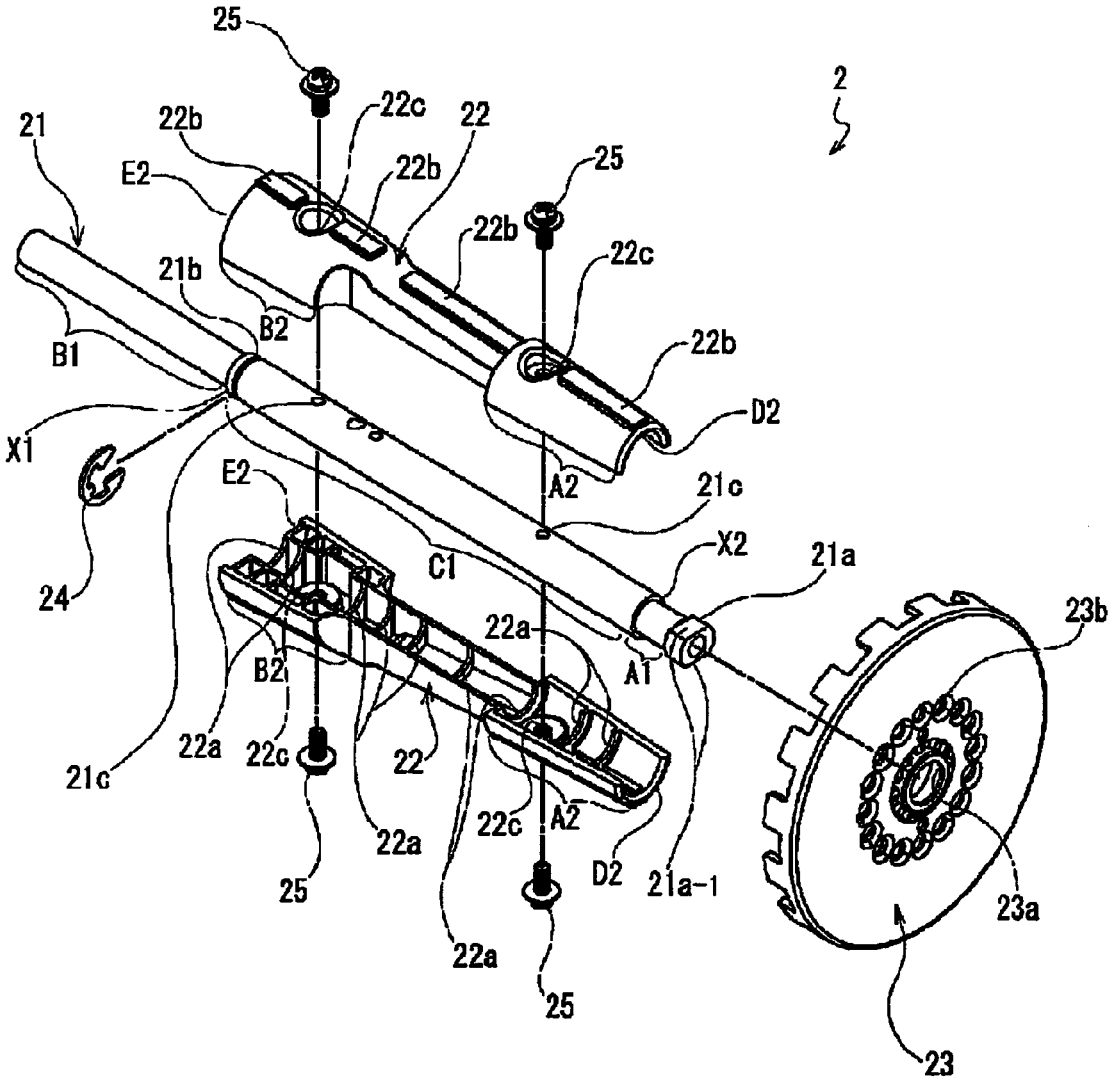
FIG. 3 is an exploded perspective view of an inner circumferential member shown in FIG. 2.

FIG. 3 is an exploded perspective view of the inner circumferential member 2 shown in FIG. 2. As shown in FIG. 3, steps X2, X1 are provided between a distal end portion A1 and a central portion C1 and between a base end portion B1 and the central portion C1 of the rotary shaft 21. The distal end portion A1 and the base end portion B1 have outer diameters less than that of the central portion C1. Further, the rotary shaft 21 is provided with an engagement portion 21*a* further on the distal end side from the distal end portion A1. The engagement portion 21*a* has an outer diameter that is almost equal to that of the central portion C1 of the rotary shaft 21 and comprises a pair of flat surfaces 21*a*-1 in the mutually parallel arrangements on both sides of the central axis. The distance between the two flat surfaces 21*a*-1, 21*a*-1 is set smaller than the outer diameter of the engagement portion 21*a* that is located between the two flat surfaces 21*a*-1, 21*a*-1. An annular groove 21*b* is formed in the central portion C1 of the rotary shaft 21 on the base end portion B1 side thereof. The annular groove 21*b* is formed along the circumferential direction of the rotary shaft 21. A lock ring 24 is inserted into the annular groove 21*b*. Further, threaded holes 21*c* are provided in the central portion C1 of the rotary shaft 21. The threaded holes 21*c* are provided with threads such that screws can be screwed therein.

Two members 22 with a reducing outer diameter have identical structures; they are assembled and attached to the rotary shaft 21. The members 22 with a reducing outer diameter are formed from a synthetic resin such as a plastic. The member 22 with a reducing outer diameter as a whole has an outer surface shape such that the outer diameter thereof decreases gradually from a base end E2 (one end portion) to a distal end D2 (other end portion). Further, a plurality of ribs 22*a* are provided on the inner surface of the member with a reducing outer diameter from the base end E2 to the distal end D2. These ribs 22*a* have a circular-arc inner surface shape having an inner diameter almost equal to the outer diameter of the central portion of the rotary shaft 21. The inner circumferential edge portion of the distal end D2 of the member 22 with a reducing outer diameter has a shape that is bent inwardly on the base end E2 side of the member 22 with a reducing outer diameter. A guide protruding portion 22*b* extending from the base end E2 to the distal end D2 is provided in the central portion in the width direction of the outer circumferential surface of the member 22 with a reducing outer diameter. Further, insertion holes 22*c* are provided in the distal end portion A2 and the base end portion B2 of the central portion in the width direction of the member 22 with a reducing outer diameter. The insertion holes 22*c* serve to insert screws.

The shaft flange 23 serves to support a side surface of the ink ribbon IR that is wound on the winding reel 1 for a band-shaped material. The shaft flange 23 is formed from a synthetic resin such as a plastic. An insertion hole 23*a* for inserting the rotary shaft 21 is provided in the shaft flange 23. Further, a plurality of mating holes 23*b* are disposed so as to form a ring around the insertion hole 23*a*.

The inner circumferential member 2 is assembled, for example, by the following procedure (1) to (3). This procedure is selected arbitrarily and the inner circumferential member 2 may be also assembled by another sequence of operations.

(1) A lock ring 24 is inserted into the annular groove 21*b* of the rotary shaft 21.

(2) The rotary shaft 21 is inserted by the distal end portion A1 thereof into the insertion hole 23*a* of the shaft flange 23.

(3) The rotary shaft 21 is put between the two members 22 with a reducing outer diameter, the inner circumferential end surfaces of the members with a reducing outer diameter are brought into contact and mated, and screws 25 are screwed in this state into the threaded holes 21*c* of the rotary shaft 21 via the insertion holes 22*c* of the members 22 with a reducing outer diameter.

In such assembled state, the shaft flange 23 is put between the lock ring 24 and the end surface of the base end E2 of the member 22 with a reducing outer diameter and aligned in the axial direction.

Figure 4:
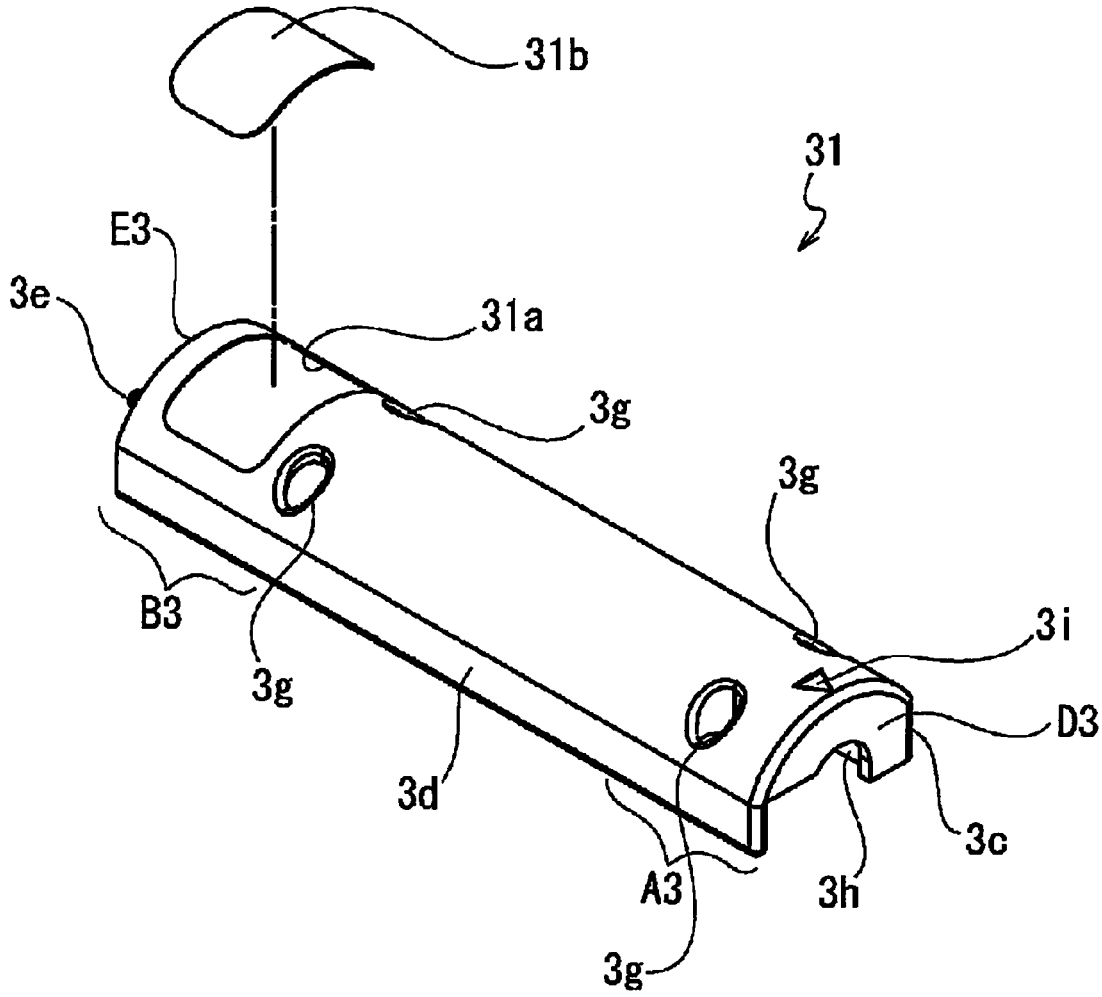
FIG. 4 is a perspective view of a mating member constituting the outer circumferential member shown in FIG. 2.
Figure 5:
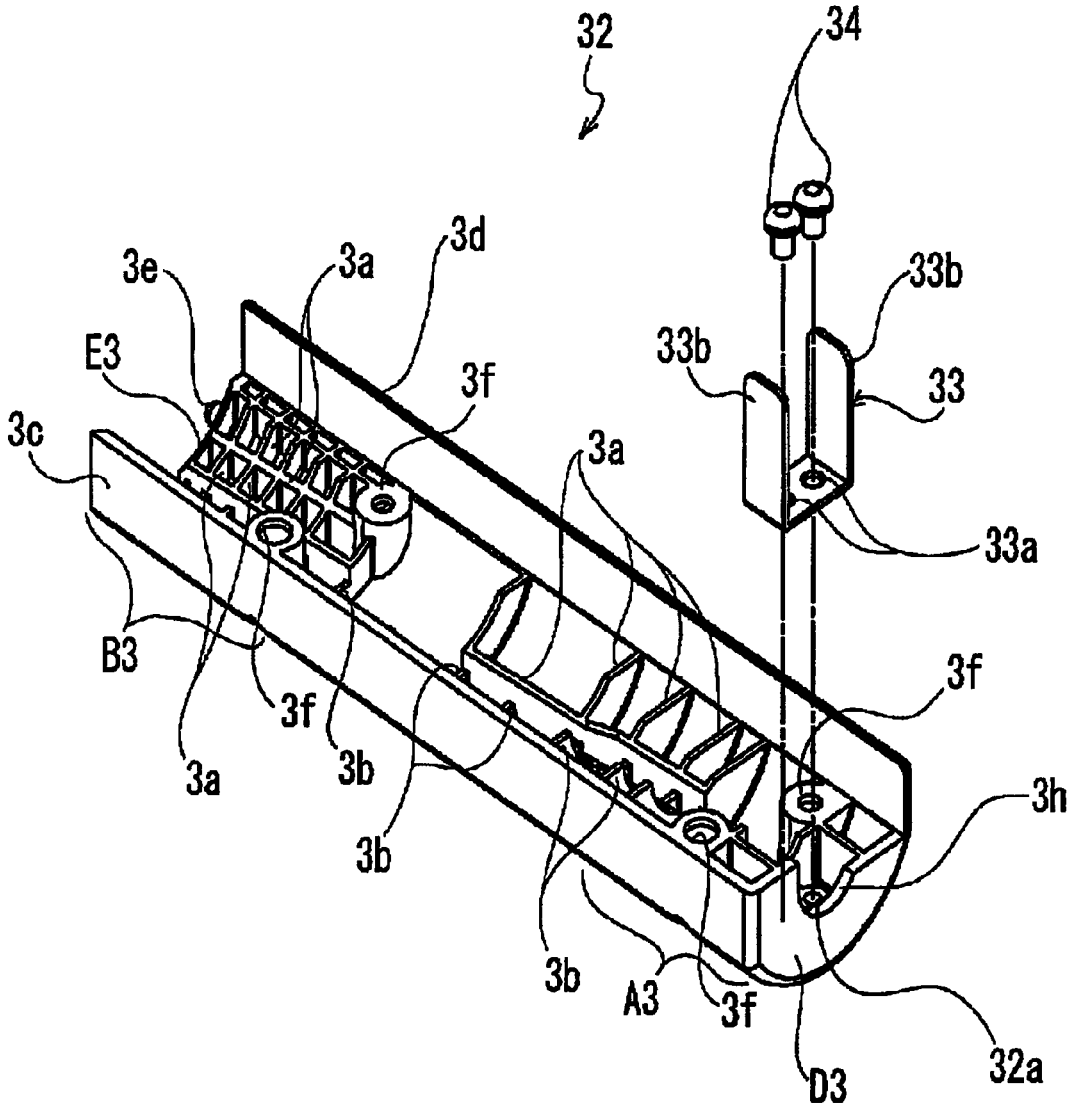
FIG. 5 is a perspective view of a mating member constituting the outer circumferential member shown in FIG. 2.

FIG. 4 is a perspective view illustrating a first mating member 31 constituting the outer circumferential member 3 shown in FIG. 2 (referred to hereinbelow simply as "mating member 31"), and FIG. 5 is a perspective view illustrating a second mating member 32 constituting the outer circumferential member 3 (referred to hereinbelow simply as "mating member 32").

The mating members 31, 32 have a shape obtained by splitting a cylindrical body in two in a lengthwise direction and are formed from a synthetic resin such as a plastic. As shown in FIG. 4, the mating members 31, 32 have an outer surface shape comprising a circumferential surface of almost uniform outer diameter from a base end E3 to the distal end D3. Further, as shown in FIG. 5, the mating members 31, 32 comprise a plurality of ribs 3*a* from the base end E3 to the distal end D3. Because of these ribs 3*a*, the mating members 31, 32 have as a whole a circular-arc inner surface shape such that the inner diameter decreases gradually from the base end E3 to the distal end D3. The inner diameter of the circular-arc inner surface shape of the ribs 3*a* provided at the mating members 31, 32 is somewhat larger than the outer diameter of the members 22 with a reducing outer diameter and is set to decrease from the base end E3 to the distal end D3 at an almost the same ratio as the outer diameter of the members 22 with a reducing outer diameter. As a result, in the mating members 31, 32 the portion with a reducing inner diameter that is formed by the ribs 3*a* whose inner diameter decreases from the base end E3 to the distal end D3 is constituted by the inner surface of the mating members.

Guide receding portions 3*b* formed by the ribs 3*a* that cave in on the outer surface side are formed from the base end E3 to the distal end D3 of the mating members 31, 32 in the central portion in the width direction of the inner surface of the mating members 31, 32. The guide receding portions 3*b* are assembled with the guide protruding portions 22*b* of the members 22 with a reducing outer diameter and serve to perform alignment of the mating members 31, 32 in the circumferential direction. Further, as shown in FIG. 4 and FIG. 5, the mating members 31, 32 have a shape comprising a flat portion 3*c* configured by forming one end surface in the width direction as a flat surface and a flat portion 3*d* configured by forming another end surface in the width direction as a flat surface. A curved edge portion 3*h* that recedes as a circular arc is provided at the edge portion on the inner surface side of the distal end D3 of the mating members 31, 32.

As shown in FIG. 4, the mating member 31 comprises a cavity 31*a* formed in the base end portion B3 and an antisliding member 31*b* that is removably attached to the cavity 31*a*. The antisliding member 31*b* is manufactured from a material with a high friction coefficient such as a rubber material and is attached to the cavity 31*a*, e.g., with a pressure-sensitive adhesive, thereby restricting the movement in the axial direction and rotation direction. Furthermore, the antisliding member is provided to prevent the ink ribbon IR from sliding and to facilitate the winding process by friction when the ink ribbon IR is wound.

Further, as shown in FIG. 5, a metal lock piece 33 is attached to the inner surface of the distal end portion A3 of the mating member 32. The lock piece 33 has a U-like shape obtained by bending a metal sheet. Two insertion holes 33*a* are provided in a side portion located between a pair of mutually opposing side portions 33*b*, 33*b*. Two threaded holes 32*a* are provided in the distal end portion A3 of the mating member 32. The lock piece 33 is attached by positioning the side portion thereof where the insertion holes 33*a* are provided along the width direction of the mating member 32, abutting this side portion against the inner surface of the mating member 32, and tightly screwing the screws 34 inserted into the insertion holes 33*a* into the threaded holes 32*a*.

A mating protrusion 3*e* is provided at the end surface of the base end E3 of the mating members 31, 32. The mating protrusion 3*e* serves to align the shaft flange 23 in the circumferential direction by mating with the mating hole 23*b* of the shaft flange 23. As shown in FIG. 5, insertion holes 3*f* are provided at both sides in the width direction of the base end portion B3 and the distal end portion A3 of the mating members 31, 32. These insertion holes 3*f* serve to insert screws 53. A concave portion 3*g* is provided as shown in FIG. 4 around the insertion hole 3*f*.

Figure 6:
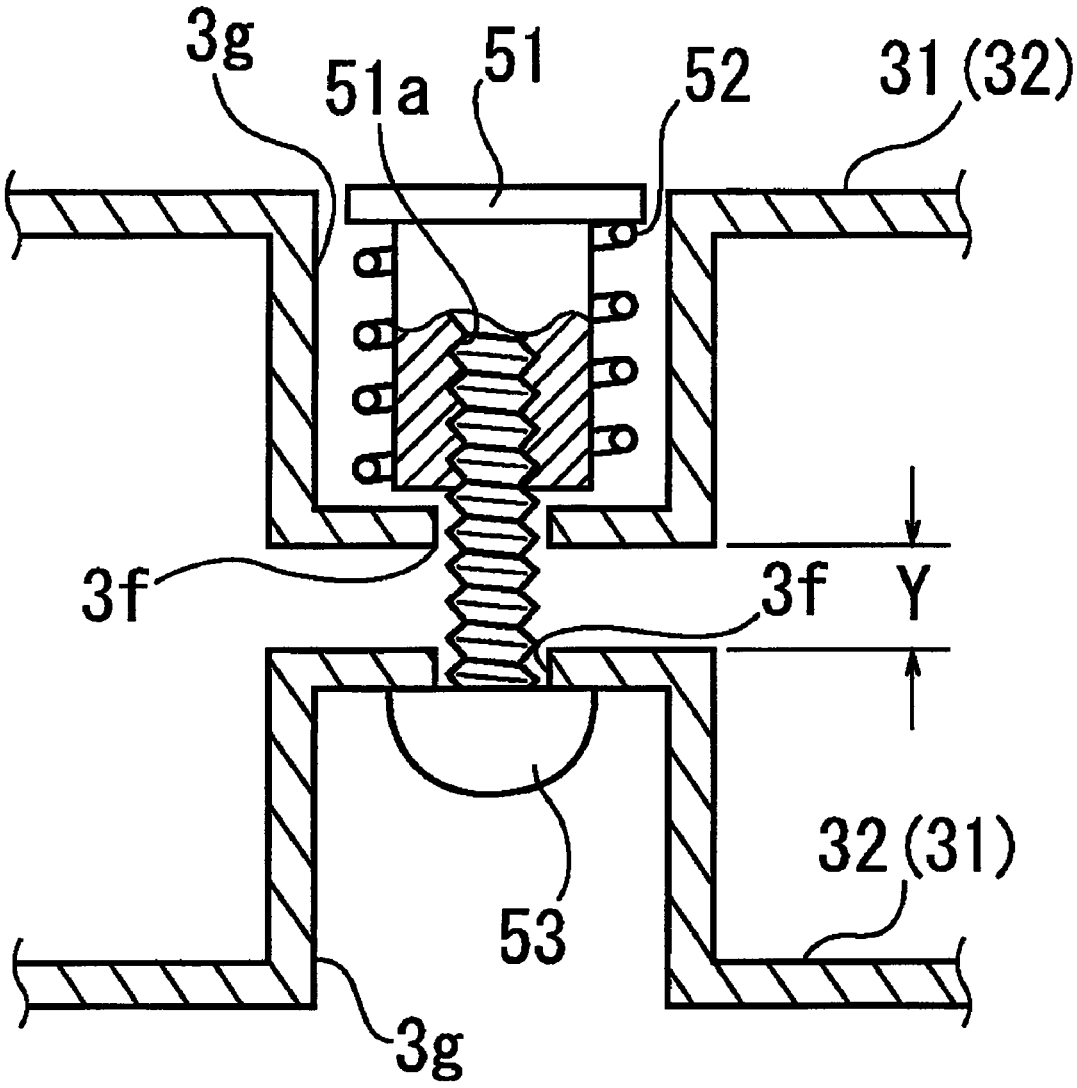
FIG. 6 is a cross-sectional view illustrating on an enlarged scale the peripheral zone of the concave portion of the mating member.

FIG. 6 is a cross-sectional view illustrating on an enlarged scale the peripheral zone of the concave portions 3*g* of the mating members 31, 32. As shown in FIG. 6, the concave portion 3*g* serves to insert a spacer 51 provided with a spring 52 in an annular fashion and the screw 53. A female threaded portion 51*a* is formed on the inner circumference of the spacer 51. Further, a mark 3*i* (see FIG. 4) having a triangular shape is formed in the central portion in the width direction of the distal ends D3 of the mating members 31, 32. The mark 3*i* is so formed that one apex of the triangular shape thereof faces the distal end D3 side of the mating members 31, 32. The mark 3*i* serves to facilitate the below-described determination of the rotation position of the fixing cap 4 by aligning the apex of the triangular shape of this mark with the below-described mark 42*a*.

The mating members 31, 32 are attached to the inner circumferential member 2 by the following procedure (1) to (5). This procedure is selected arbitrarily and the outer circumferential member 3 may be attached to the inner circumferential member 2 by another sequence of operations.

(1) The inner surfaces of the mating members 31, 32 are aligned so that the guide receding portions 3*b* can be assembled with the guide protrusions 22*b* of the member 22 with a reducing outer diameter, and the outer surface of the flat portion 3*c* and the inner surface of the flat portion 3*d* are aligned and assembled to enclose the member 22 with a reducing outer diameter of the inner circumferential member 2.

(2) The spacer 51 provided with the spring 52 in an annular fashion is disposed in one of a pair of concave portions 3*g* positioned on a diagonal line on both sides of the central portion of the mating member 31, and the screw 53 is inserted into the other concave portion 3*g*.

(3) The screw 53 is inserted into the concave portion 3*g* of the mating member 32 that faces the concave portion 3*g* of the mating member 31 where the spacer 51 is disposed, and the spacer 51 provided with the spring 52 in an annular fashion is disposed in the concave portion 3*g* of the mating member 32 facing the concave section 3*g* of the mating member 31 into which the screw 53 is inserted.

(4) As shown in FIG. 6, the spacer 51 provided with the spring 52 in an annular fashion that is disposed in the concave portion 3*g* of the mating member 31 and the screw 53 disposed in the concave portion 3*g* of the mating member 32 are screwed together via the insertion hole 3*f*, and the spacer 51 provided with the spring 52 in an annular fashion that is disposed in the concave portion 3*g* of the mating member 32 and the screw 53 disposed in the concave portion 3*g* of the mating member 31 are screwed together via the insertion hole 3*f*, whereby the mating member 31 and the mating member 32 are screwed tightly together.

(5) The mating protrusion 3*e* is inserted into the mating hole 23*b* of the shaft flange 23.

The mating member 31 and the mating member 32 are thus assembled together and attached to the inner circumferential member 2, and the outer circumferential member 3 is configured. As shown in FIG. 6, a state is assumed in which a gap Y is formed between the end surface on the inner side of the mating member 31 that is attached to the inner circumferential member 2 and the end surface on the inner side of the mating member 32, and the diameter of the outer circumferential member 3 is reduced by decreasing the spacing of this gap Y.

Figure 7:
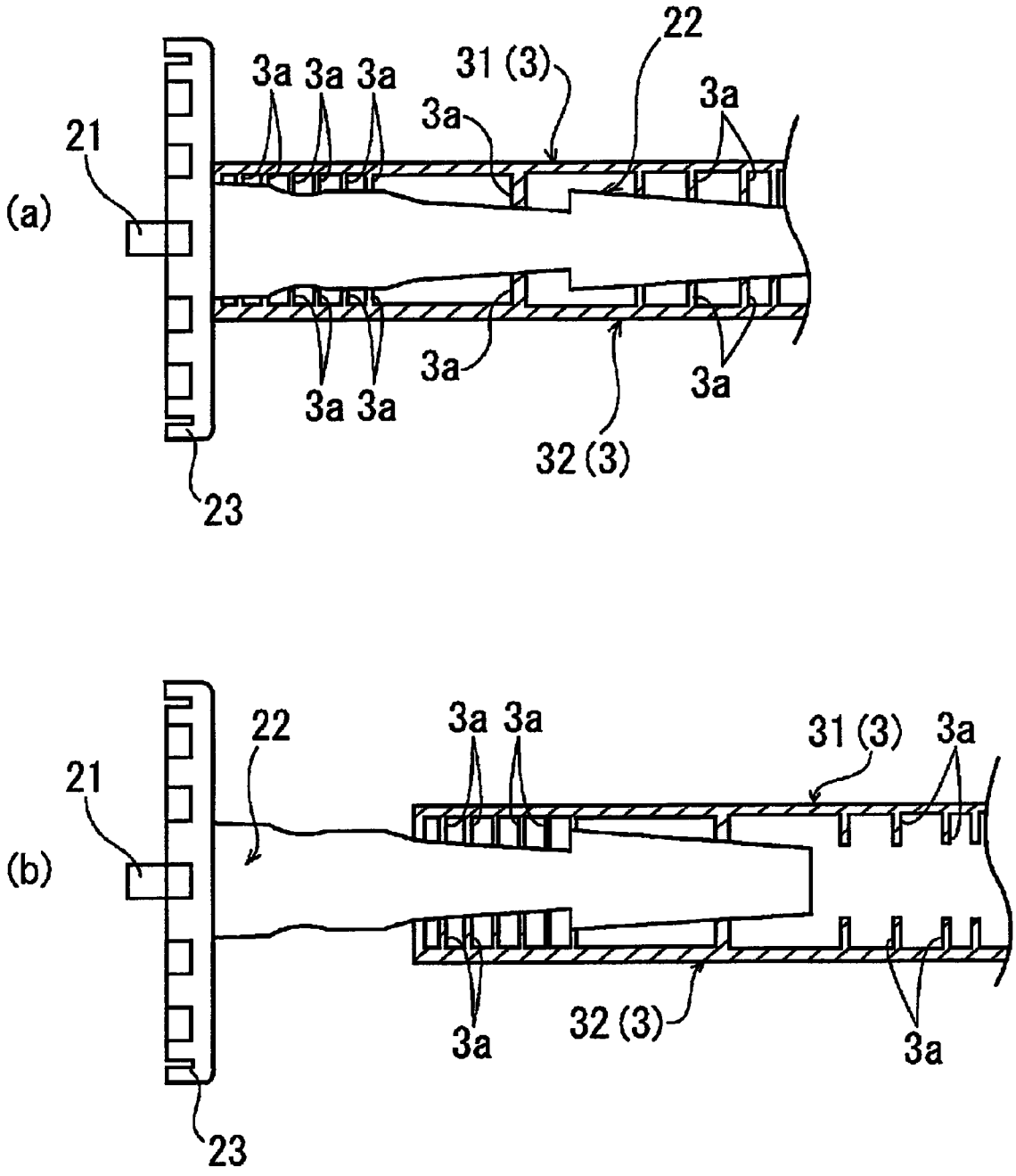
FIG. 7 is a cross-sectional view illustrating schematically the configuration of the outer circumferential member attached to the member with a reducing outer diameter.

FIG. 7 is a cross-sectional view illustrating schematically the configuration of the outer circumferential member 3 attached to the member 22 with a reducing outer diameter.

As shown in FIG. 7, the mating members 31, 32 constituting the outer circumferential member 3 are abutted by the inner surface thereof against the outer surface of the member 22 with a reducing outer diameter, thereby being supported by the member 22 with a reducing outer diameter. In other words, by applying a force from the outer surface side that includes a biasing force applied from the spring 52 inserted between the spacer 51 and the mating members 31, 32, the mating members 31, 32 are moved in the direction of diameter reduction of the member 22 with a reducing outer diameter, that is, toward the distal end D2, and attached to the member 22 with a reducing outer diameter.

A degree to which the mating member 31 and the mating member 32 are tightened together, that is, a degree to which the spacer 51 and the screw 53 are tightened together via the insertion hole 3*f*, is adjusted according to the type of material of the ink ribbon IR that will be wound on the winding reel 1 for a band-shaped material and the wound quantity or winding speed of the ink ribbon IR. For example, when the winding speed of the ink ribbon IR is high, a strong tightening force is generated in the wound ink ribbon IR. Therefore, the outer circumferential member 3 can be reduced in diameter even if a force that is generated by the biasing force of the spring 52 and tightens the mating members 31, 32 is small. Therefore, a degree to which the spacer 51 and the screw 53 are tightened together is set low. On the other hand, when the winding speed of the ink ribbon IR is low, the tightening force generated in the wound ink ribbon IR is low, and the outer circumferential member 3 will not be reduced in diameter unless the mating members 31, 32 are strongly tightened together by the biasing force of the spring 52. Therefore, a degree to which the spacer 51 and the screw 53 are tightened together is set high. Thus, a degree to which the spacer 51 and the screw 53 are tightened together can be set such that the biasing force applied from the spring 52 will be sufficient to enable, together with the tightening force generated in the ink ribbon IR, the movement of the mating members 31, 32 toward the distal end D2 of the member 22 with a reducing outer diameter. The spring 52 is an elastic body inserted between the mating members 31, 32 and the screw (in the present embodiment, the spacer 51) that screws together and locks the mating members 31, 32, and this spring constitutes a radial biasing means that biases the outer circumferential member 3 composed of the mating member 31 and the mating member 32 in the direction of diameter reduction.

Figure 8:
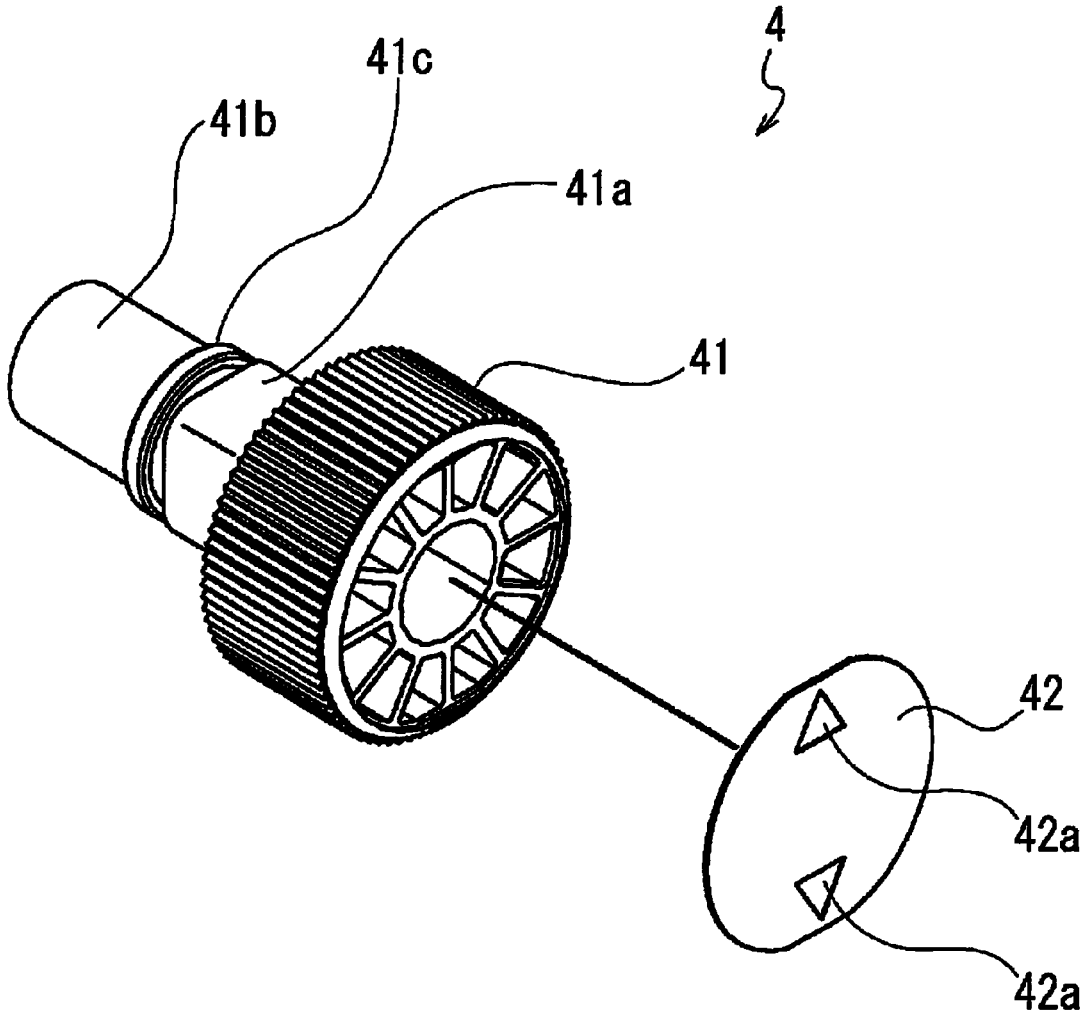
FIG. 8 is a perspective view of the fixing cap shown in FIG. 2.

FIG. 8 is a perspective view of the fixing cap 4 shown in FIG. 2. As shown in FIG. 8, the fixing cap 4 comprises a cylindrical holding portion 41, a lock body 41*a* provided in the central portion of one end surface of the holding portion 41, a fixing tube 41*b* protruding from the lock body 41*a*, and a disk body 42 attached to the other end surface of the holding portion 41. The fixing cap 4 is formed from a synthetic resin such as a plastic.

The lock body 41*a* has a rectangular cross section in the direction perpendicular to the axial direction of the fixing cap 4. The distance between the mating side portions 33*b*, 33*b* of the lock piece 33 attached to the mating member 32 shown in FIG. 5 is set larger than the length of one side constituting the outer periphery of this lock body 41*a* and smaller than the length of the line connecting the opposite corners thereof.

The fixing tube 41*b* has an outer diameter that is less than the inner diameter of the spring 6 and an inner diameter that is larger than the maximum outer diameter of the engagement portion 21*a* of the rotary shaft 21. A projection 41*c* is formed on the outer circumference of the fixing tube at the side of the lock body 41*a*. Projection 41*c* is formed along the circumferential direction of the fixing tube 41*b* and has a ring-like shape. The projection 41*c* locks one end of the spring 6 at the end surface of the fixing tube 41*b* that is on the side opposite that of the lock body 41*a* and serves to put the curved edge portions 3*h* of the mating members 31, 32 between the end surface at the side of the lock body 41*a* and the end surface at the side of the projection 41*c* of the lock body 41*a*. A pair of protruding pieces (not shown in the figures) are provided opposite each other on both sides of the central axis of the fixing tube 41*b* on the inner circumference of the fixing tube 41*b*. The formation positions of the protruding pieces in the circumferential direction of the fixing tube 41*b* are set to the positions identical to those of a pair of side portions that face each other and constitute the outer circumference of the lock body 41*a*. The distance between the distal ends of the two protruding pieces is set larger than the distance between the flat surfaces 21*a*-1, 21*a*-1 of the engagement portion 21*a* and smaller than the maximum outer diameter of the engagement portion 21*a*. Further, a pair of marks 42*a*, 42*a* having a triangular shape are formed on the surface of the disk body 42. The marks 42*a*, 42*a* are formed so that one apex of the triangle faces the circumferential edge direction of the disk body 42 and so that one side portion of one mark is parallel to one side portion of the other mark. The disk body 42 is attached to the holding portion 41 so that the marks 42*a*, 42*a* are located in the same positions as the formation positions of the protruding pieces of the fixing tube 41*b* in the circumferential direction of the holding portion 41. The marks 42*a* facilitate the below-described determination of the rotation position of the fixing cap 4 by aligning the apex of the triangular shape of this mark with the above-described mark 3*i*.

The fixing cap 4 is attached to the rotary shaft 21 of the inner circumferential member 2 by the following procedure (1) to (3). This procedure is selected arbitrarily and fixing cap 4 may be also attached to the rotary shaft 21 by another sequence of operations.

(1) The fixing tube 41*b* is inserted through the spring 6 in a state in which the position with respect to the rotary shaft 21 is maintained so that the outer circumferential portions of the two flat surfaces 21*a*-1, 21*a*-1 of the engagement portion 21*a* are located between the two protruding pieces in the fixing tube 41*b*.

(2) The distal end portion A1 of the rotary shaft 21 is inserted into the fixing tube 41*b*.

(3) After the two protruding pieces in the fixing tube 41*b* have passed sidewise of the engagement portion 21*a* of the rotary shaft 21, the holding portion 41 is rotated and the engagement portion 21*a* is locked at the circular-arc outer circumferential portion of the engagement portion 21*a*.

In the fixing cap 4 attached to the rotary shaft 21 in the above-described manner, one end of the spring 6 is locked by the end surface aligned with the inner circumferential member 2 of the projection 41*c*. After the fixing cap 4 has been attached to the rotary shaft 21, the mating members 31, 32 are attached and the curved edge portions 3*h* of the mating members 31, 32 are put between the projection 41*c* and the lock body 41*a*, thereby restricting the movement of the mating members 31, 32 in the axial direction. The spring 6 inserted between the fixing cap 4 and the rotary shaft 21 biases the fixing cap 4 toward the distal end of the winding reel 1 for a band-shaped material, and the mating members 31, 32 whose curved edge portions 3*h* are put between the projection 41*c* and the lock body 41*a* are also biased toward the distal end of the winding reel 1 for a band-shaped material via the fixing cap 4. The fixing cap 4 and the engagement portion 21*a* constitute a fixing means for releasably fixing the attachment position of the outer circumferential member 3 to the inner circumferential member 2. Further, the spring 6 constitutes an axial biasing means for biasing the outer circumferential member 3 from the base end E3 toward the distal end D3. As described above, in the present embodiment, the spring 6 constituting the axial biasing means biases the outer circumferential member 3 toward the distal end of the winding reel 1 for a band-shaped material via the fixing cap 4.

Figure 9:
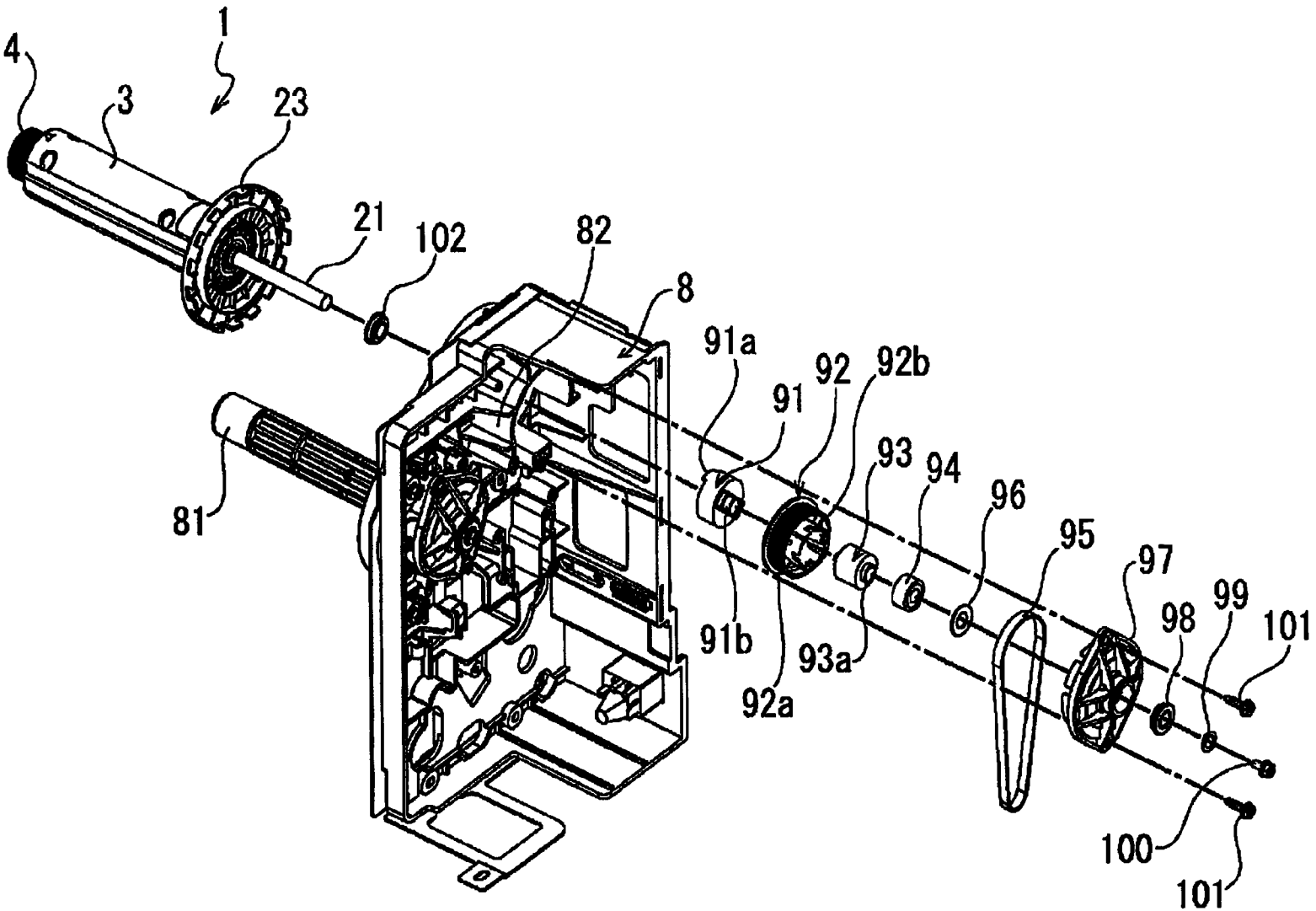
FIG. 9 is an exploded perspective view illustrating part of the configuration of the winding device for a band-shaped material that comprises the winding reel for a band-shaped material of the present embodiment.

FIG. 9 is an exploded perspective view illustrating part of the configuration of the winding device for a band-shaped material that comprises the winding reel 1 for a band-shaped material of the present embodiment.

The winding device for a band-shaped material shown in FIG. 9 serves to wind directly an ink ribbon IR that is wound on a reel 81 on the winding reel 1 for a band-shaped material. In the winding reel 1 for a band-shaped material, the rotary shaft 21 protruding from the shaft flange 23 toward the side of a device body 8 of the winding device for a band-shaped material is rotatably supported and attached to the device body 8.

The device body 8 is equipped with a drive mechanism comprising a bearing 91, a pulley 92, a sliding body 93, a bearing 94, and a belt 95. The bearing 91 is attached to the device body 8 and aligned by mating a mating piece 91*a* provided at one end surface thereof with a mating portion (not shown in the figure) that is provided at a drive mechanism accommodation section 82 of the device body 8. The pulley 92 comprises a cylindrical belt carrying portion 92*a* that carries the belt 95 and a cylindrical sliding portion 92*b* that has an outer diameter less than that of the belt carrying portion 92*a* and serves to insert the sliding body 93. The sliding body 93 comprises an insertion hole 93*a* for inserting the rotary shaft 21 and is fixed to the inserted rotary shaft 21 with a key or the like. The bearing 94 is inserted into a cover 97 via a washer 96. The cover 97 is tightly screwed to the drive mechanism accommodation section 82 with a screw 101.

The rotary shaft 21 is inserted into the drive mechanism accommodation section 82 of the device body 8 via a bushing 102 and inserted through the bearing 91, pulley 92, sliding body 93, bearing 94, and cover 97. The rotary shaft 21 inserted into the cover 97 is inserted into the bushing 98, tightly screwed to the cover 97 with a screw 100 via a washer 99, and attached to the device body 8. Where the belt 95 is rotated by the rotation of a motor (not shown in the figure), the pulley 92 is rotated and the sliding body 93 located inside a sliding portion 92*b* of the pulley 92 is rotated integrally with the rotary shaft 21. If a large load is applied to the rotary shaft 21 of the winding reel 1 for a band-shaped material, the sliding portion 92*b* of the pulley 92 and the sliding body 93 slide, thereby preventing the winding reel 1 for a band-shaped material and motor from damage.

The operations performed when the ink ribbon IR is wound on the winding reel 1 for a band-shaped material in the winding device for a band-shaped material of the above-described configuration will be described below.

Figure 10:
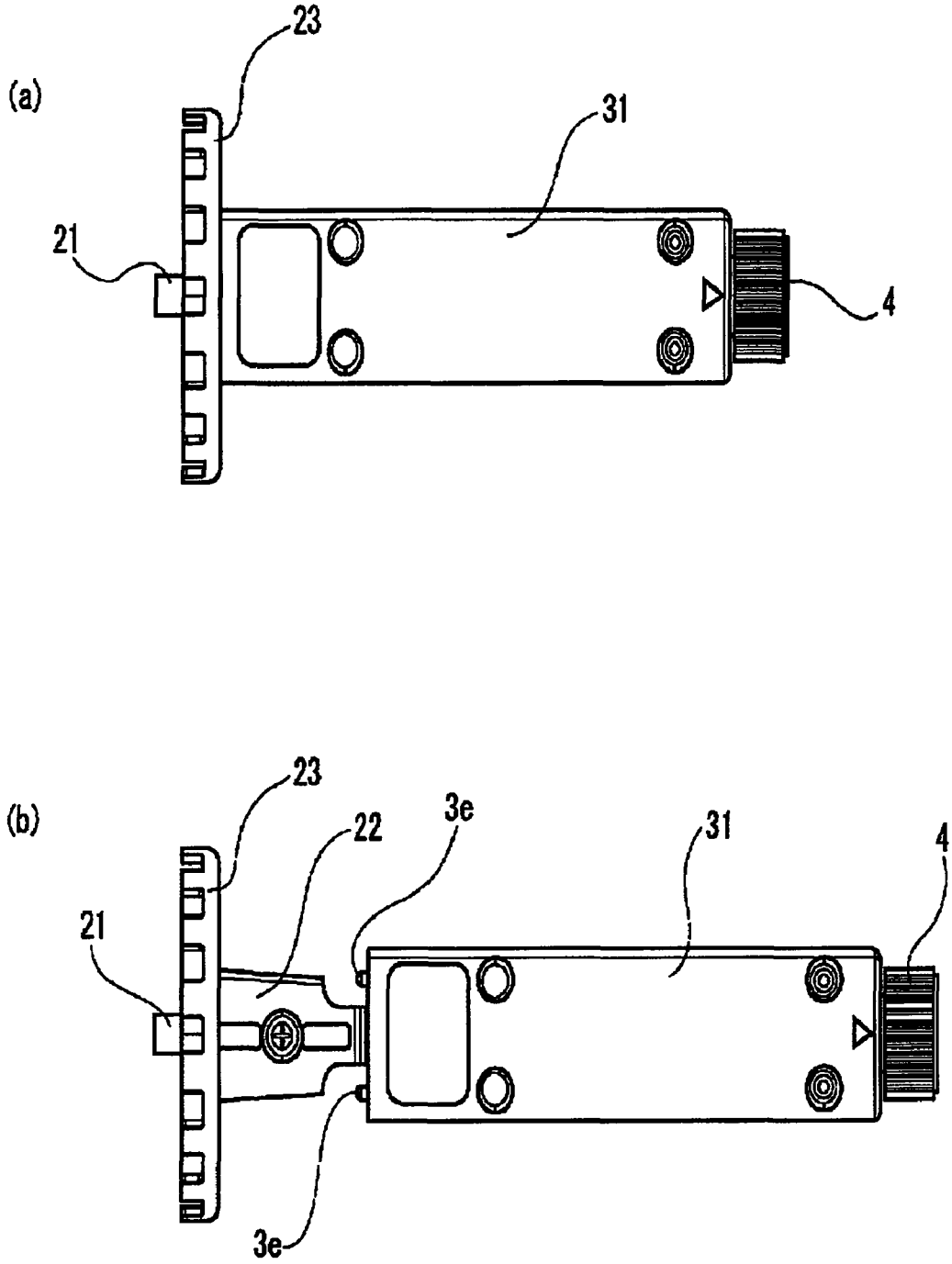
FIG. 10 is a side view of the winding reel for a band-shaped material.
Figure 11:
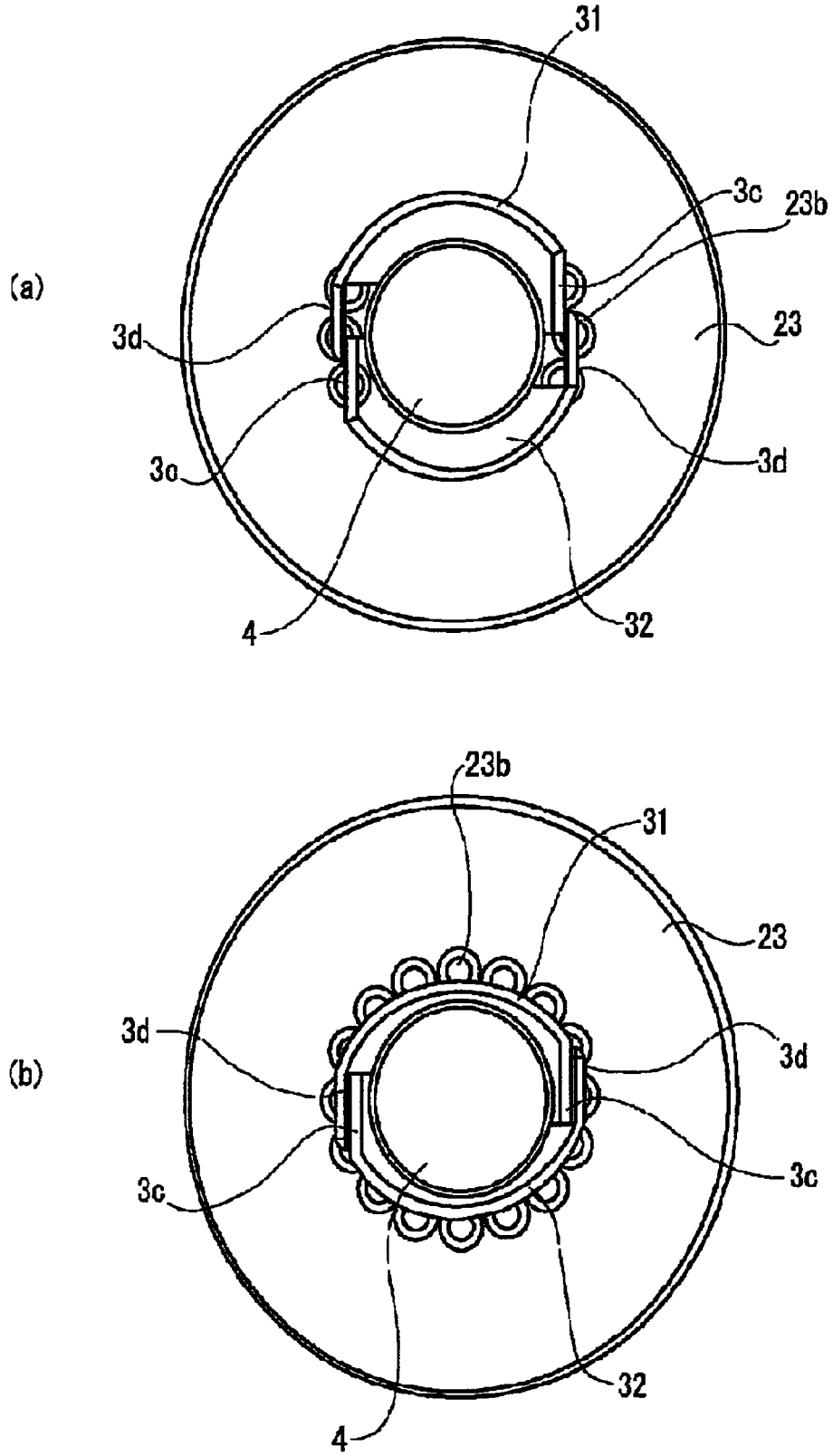
FIG. 11 is a side view of the winding reel for a band-shaped material.

FIG. 10 is a side view of the winding reel 1 for a band-shaped material, FIG. 10A shows a state before the diameter of the outer circumferential member 3 is reduced, and FIG. 10B shows a state after the diameter of the outer circumferential member 3 has been reduced. FIG. 11 is a view on the winding reel 1 for a band-shaped material from the distal end side, FIG. 11A shows a state before the diameter of the outer circumferential member 3 is reduced, and FIG. 11B shows a state after the diameter of the outer circumferential member 3 has been reduced.

When the ink ribbon IR is wound on the winding reel 1 for a band-shaped material, the holding portion 41 of the fixing cap 4 is inserted into the distal end D2 of the outer circumferential member 2 and rotated, and the protruding piece located inside the fixing tube 41*b* is engaged with the engagement portion 21*a* of the rotary shaft 21. Following this operation, as shown in FIG. 10A, the mating protrusions 3*e* of the mating members 31, 32 attached to the outer circumferential member 2 are inserted into the mating holes 23*b* of the shaft flange 23, and the base ends E3 of the mating members 31, 32 come into contact with the shaft flange 23. Further, as shown in FIG. 11A, a state is assumed in which only the edges of the parallel portion 3*c* and the parallel portion 3*d* of the mating members 31, 32 are in contact with each other. In this state, the biasing force created by the spring 52 is adjusted by adjusting the degree to which the spacer 51 and the screw 53 are tightened together according to the type of material of the ink ribbon IR wound on the winding reel 1 for a band-shaped material, winding quantity, and winding speed. As a result, a state is assumed in which the ink ribbon IR can be wound on the winding reel 1 for a band-shaped material.

In this state the mark 42*a* of the fixing cap 4 is in a position that does not face the mark 3*i* of the mating members 31, 32. Further, the rotation of the fixing cap 4 is restricted by positioning the lock body 41*a* of the fixing cap 4 between the side portions 33*b*, 33*b* of the lock piece 33 and abutting the lock body 41*a* against the lock piece 33. The fixing cap 4 is biased toward the distal end of the winding reel 1 for a band-shaped material by the spring 6, but the movement of the fixing cap 4 is restricted by locking the engagement portion 21*a* of the rotary shaft 21 at the locking piece located inside the fixing tube 41*b*. A force acting in the direction of diameter reduction is applied to the outer circumferential member 3 by the spring 52 disposed between the spacer 51 and the screw 53. As shown in FIG. 7A, because the inner surfaces of the mating members 31, 32 are supported at the member 22 with a reducing outer diameter in which the outer surface is tapered and decreases in diameter from the base end E2 toward the distal end D2, a force causing the movement toward the distal end D2 of the member 22 with a reducing outer diameter also acts upon the mating members 31, 32. As a result, the distal end D3 of the mating members 31, 32 comes into contact with the lock body 41*a* of the fixing cap 4, and the fixing cap 4 is pushed in the direction opposite that of the member 22 with a reducing outer diameter, but because the movement of the fixing cap 4 is restricted by the engagement of the protruding piece located inside the fixing tube 41*b* and the engagement portion 21*a* of the rotary shaft 21, a state in which the movement of the mating members 31, 32 is restricted is maintained.

In the winding reel 1 for a band-shaped material attached to the winding device for a band-shaped material in the above-described manner, as shown in FIG. 1, the ink ribbon IR is wound by bonding a distal end of the ink ribbon IR that is to be wound to the winding reel 1 for a band-shaped material with a tape T and then rotating the rotary shaft 21 with the above-described drive mechanism.

The outer circumferential member 3 is tightened on the wound ink ribbon IR, and the inner surface of the outer circumferential member is pressed against the outer surface of the member 22 with a reducing outer diameter. Because the member 22 with a reducing outer diameter has an outer surface shape with a tilted outer surface and the diameter thereof decreases from the base end E2 toward the distal end D2, a force acts upon the outer circumferential member 3 so as to move it toward the distal end D2 of the member 22 with a reducing outer diameter, but because of the above-described abutment of the fixing cap 4 against the lock body 41*a*, a state in which the movement of the outer circumferential member 3 is restricted is maintained.

When the winding of the ink ribbon IR is completed, the fixed state of the attachment position of the outer circumferential member 3 with the fixing cap 4 is released. This is performed by holding the holding portion 41 of the fixing cap 4 and rotating the holding portion to the left or to the right till the mark 42*a* of the fixing cap 4 comes to a position facing the mark 3*i* of the mating members 31, 32. With this operation, the side portions 33*b*, 33*b* of the lock piece 33 are bent, the lock body 41*a* passes between these side portions 33*b*, 33*b*, the locking of the locking piece located inside the fixing tube 41*b* of the fixing cap 4 and the locking portion 21*a* of the rotary shaft 21 is released, the fixing cap 4 is moved toward the distal end of the winding reel 1 for a band-shaped material by the biasing force of the spring 6, and the fixing cap is pushed out from the distal end portion A1 of the rotary shaft 21. The mating members 31, 32 in which the curved edge portions 3*h* are put between the projection 41*c* and the lock body 41*a* of the fixing cap 4 move together with the fixing cap 4 toward the distal end of the winding reel 1 for a band-shaped material. In other words, from the state shown in FIG. 7A, the inner surfaces of the mating members 31, 32 move along the outer surface of the member 22 with a reducing outer diameter toward the distal end side of the winding reel 1 for a band-shaped material, the gap Y shown in FIG. 6 that is formed between the end surface on the inner side of the mating member 31 and the end surface on the inner side of the mating member 32 is decreased in size, and a state is assumed in which the diameter of the outer circumferential member 3 is reduced, as shown in FIG. 7B.

In this state, as shown in FIG. 10B, in the outer circumferential member 3 attached to the member 22 with a reducing outer diameter, the mating protrusions 3*e* of the mating members 31, 32 are pulled out from the mating holes 23*b* of the shaft flange 23 and the entire outer circumferential member moves toward the distal end D2 of the member 22 with a reducing outer diameter. Further, as shown in FIG. 11B, the flat portion 3*c* and the flat portion 3*d* of the mating members 31, 32 are brought into contact with each other over the entire surface. By thus reducing the diameter of the outer circumference of the outer circumferential member 3, a gap is generated between the outer circumferential member 3 and the inner circumferential portion, and the wound ink ribbon IR can be removed from the winding reel 1 for a band-shaped material.

After the wound ink ribbon IR has been pulled out from the winding reel 1 for a band-shaped material, the fixing cap 4 is pushed together with the mating members 31, 32 toward the base end E2 of the outer circumferential member 2, the fixing cap 4 is engaged with the engagement portion 21*a* of the rotary shaft 21, and the mating protrusions 3*e* of the mating members 31, 32 are inserted into the mating holes 23*b* of the shaft flange 23, thereby returning to the above-described state in which the ink ribbon IR can be rotated. As a result, a new operation of winding an ink ribbon IR can be performed.

Thus, with the winding reel 1 for a band-shaped material of the present embodiment, the wound ink ribbon IR can be removed from the winding reel 1 for a band-shaped material by a simple operation of rotating the fixing cap 4 and releasing the fixed state attained with the fixing means. Moreover, because the outer circumferential member 3 moves toward the distal end D2 of the member 22 with a reducing outer diameter and the outer diameter of the entire outer circumferential member 3 is reduced, the gap formed with the wound ink ribbon IR can be made uniform from the base end to the distal end of the winding reel 1 for a band-shaped material. Therefore, the ink ribbon IR that is wound on the winding reel 1 for a band-shaped material can be easily removed therefrom without adjusting the winding speed by taking into account the tightening force generated in the ink ribbon IR.

Further, with the winding reel 1 for a band-shaped material of the present embodiment, even when a sufficient force causing the reduction of diameter of the outer circumferential member 3 is not applied from the ink ribbon IR, for example, because the amount of the ink ribbon IR wound on the outer circumference of the outer circumferential member 3 is insufficient, when the fixed state of the attachment position of the outer circumferential member 3 is released by rotating the fixing cap 4, the outer circumferential member 3 is biased in the direction of diameter reduction by the spring 52 and also biased toward the distal end side of the winding reel 1 for a band-shaped material by the spring 6, whereby the outer circumferential member 3 is moved toward the distal end D2 of the member 22 with a reducing outer diameter and the outer circumferential member 3 can be reduced in diameter. Therefore, the operation effect according to which the ink ribbon IR that is wound on the winding reel 1 for a band-shaped material can be easily removed without performing the adjustment of the winding speed that takes into account the tightening force generated in the ink ribbon IR can be obtained even more reliably.

Further, with the winding reel 1 for a band-shaped material of the present embodiment, the value of the force that causes the diameter reduction of the outer circumferential member 3 can be adjusted by a simple operation of adjusting the tightness of screwing together the mating members 31, 32. Therefore, a biasing force sufficient to move the outer circumferential member 3 toward the distal end D2 of the member 22 with a reducing outer diameter and to reduce the diameter of the outer circumferential member 3 can be caused to act upon the outer circumferential member 3, regardless of the tightening force applied from the ink ribbon IR. As a result, the operation effect according to which the ink ribbon IR that is wound on the winding reel 1 for a band-shaped material can be easily removed without performing the adjustment of the wiring speed that takes into account the tightening force generated in the ink ribbon IR can be obtained even more reliably.

Further, in the present embodiment the case is explained in which the present invention is applied to a configuration in which the member 22 with a reducing outer diameter that had a shape such that only part of the outer surface is inclined toward the rotary shaft 21 from the base end E2 side to the distal end D2 side is taken as a portion with a reducing outer diameter. However, the member 22 with a reducing outer diameter can have any shape, provided that the outer surface shape thereof has a tapered surface inclined in the direction of diameter reduction from the base end E2 side toward the distal end D2 side, that the diameter of the entire member decreases from the base end E2 side toward the distal end D2 side, and that the movement of the outer circumferential member 3 toward the distal end D2 is not impeded. For example, the member with a reducing outer diameter may have a shape such that the entire outer surface is tapered so as to be inclined toward the inner surface from the base end E2 side toward the distal end D2 side.

Further, in the present embodiment, a case is explained in which the portion with a reducing inner diameter is configured by the ribs 3*a* provided on the inner surfaces of the mating members 31, 32. However, the portion with a reducing inner diameter can have any shape, provided that the inner surfaces of the mating members 31, 32 as a whole have a tapered surface inclined in the direction of diameter reduction from the base end E3 side toward the distal end D3 side, that the diameter of the entire portion decreases from the base end E3 side toward the distal end D3 side, and that the movement of the outer circumferential member 3 toward the distal end D3 is not impeded. For example, the portion with a reducing inner diameter may have a shape such that the entire outer surface is tapered so as to be inclined toward the inner surface from the base end E3 side toward the distal end D3 side. Further, no restriction is placed on the configuration of the outer circumferential member, provided that it has a portion with a reducing inner diameter and can be expanded and contracted in the radial direction and that the portion with a reducing inner diameter is attached to the inner circumferential member by being supported on the portion with a reducing outer diameter. For example, in the present embodiment, a case is explained in which the outer circumferential member 3 is configured by assembling the mating member 31 and the mating member 32, each mating member having a shape obtained by splitting a cylindrical body along the circumferential direction, but the outer circumferential member 3 may be also configured by three mating members, each having a shape obtained by splitting a cylindrical body in three sections.

In the present embodiment, a case is explained in which the radial biasing means is configured by the spring 52 inserted between the spacer 51 and the mating members 31, 32, but the radial biasing means may be also configured by inserting a spring between the screw 53 and the mating members 31, 32, or by inserting springs between the spacer 51 and the mating members 31, 32 and between the screw 53 and the mating members 31, 32. Further, in the present embodiment, a case is explained in which the spacer 51 having the spring 52 provided thereon in an annular fashion and the screw 53 are screwed together via two insertion holes 3*f* from amongst four insertion holes 3*f* formed in each of the mating members 31, 32, but such tightening may be also performed via all the insertion holes 3*f*. Further, no limitation is placed on the type of the elastic body constituting the radial biasing means.

In the present embodiment, a case is explained in which the axial biasing means is configured by the spring 6 that is fit around the rotary shaft 21, but the axial biasing means may have any configuration, provided that the outer circumferential member 3 can be biased from the base end E3 side toward the distal end D3 side.

In the present embodiment, a case is explained in which the fixing cap 4 and the mating members 31, 32 moved integrally because the curved edge portions 3*h* of the mating members 31, 32 are put between the projection 41*c* of the fixing cap 4 and the lock body 41*a*. However, a configuration may be also used in which a biasing force is directly provided by the axial biasing means to the mating members 31, 32, and the fixing cap 4 and the mating members 31, 32 can move separately. Further, the fixing means also may have any configuration, provided that the movement of the mating members 31, 32 toward the distal end D2 side of the member 22 with a reducing outer diameter can be restricted.

In the present embodiment, a case is explained in which the winding reel for a band-shaped material in accordance with the present invention is used as the reel for winding an ink ribbon, but the band-shaped material that is to be wound may be of any type. For example, the winding reel for a band-shaped material in accordance with the present invention can be also applied to a reel for winding, e.g., band-shaped mounting paper having labels removably attached thereto. Further, in the present embodiment, a case is explained in which one end of the spring 6 is locked at the projection 41*c* formed at the fixing tube 41*b*. However, a configuration in which one end of the spring 6 is locked at the distal end portion of the fixing tube 41*b* may be also used.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A winding reel for a band-shaped material, the winding reel comprising:

an inner circumferential member comprising an inner circumferential member tapered portion having a first end portion and a second end portion at an opposite longitudinal end from the first end portion, the inner circumferential member tapered portion having an outer diameter tapered such that the outer diameter decreases from the first end portion toward the second end portion;

an outer circumferential member having an outer circumference and attached to an outer circumference of the inner circumferential member such that the outer circumferential member rotates integrally with said inner circumferential member and is configured to receive the band-shaped material wound on the outer circumference;

a fixing member configured to fix releasably said outer circumferential member to said inner circumferential member, wherein said outer circumferential member comprises an outer circumferential member tapered portion with an inner diameter tapered along a longitudinal extent of the winding reel such that the inner diameter decreases from a direction of said first end portion toward said second end portion and said outer circumferential member tapered portion is configured to move so as to expand or contract said outer circumferential member in a radial direction transverse to the longitudinal extent of said outer circumferential member;

said outer circumferential member tapered portion is attached to said inner circumferential member by being supported on said inner circumferential member tapered portion; and a radial biasing unit having a longitudinal extent positioned in a direction transverse to the longitudinal extent of the winding reel and configured to exert in a direction of the longitudinal extent of the radial biasing unit a biasing force for moving said outer circumferential member in the direction of the longitudinal extent of the winding reel toward said second end portion.

2. The winding reel for a band-shaped material according to claim 1, wherein said outer circumferential member is split in a longitudinal direction so as to comprise a plurality of mating members, the mating members movable in the radial direction, and said radial biasing unit comprises an elastic body positioned between said mating members and a screw positioned and configured to screw together said mating members.

* * * * *